US005332440A

United States Patent [19]

Hirshburg

[11] Patent Number: 5,332,440

[45] Date of Patent: Jul. 26, 1994

[54] COATING LIP GEOMETRY FOR SLIDE BEAD COATING

[75] Inventor: Robert I. Hirshburg, Hendersonville, N.C.

[73] Assignee: E. I. Du Pont de Nemours and Company, Wilmington, Del.

[21] Appl. No.: 103,838

[22] Filed: Aug. 13, 1993

Related U.S. Application Data

[63] Continuation of Ser. No. 823,696, Jan. 21, 1992, abandoned.

[51] Int. Cl.[5] ..... B05C 3/02

[52] U.S. Cl. ..... 118/411; 118/419; 427/402; 427/434.2

[58] Field of Search ..... 118/409, 410, 411, 412, 118/419; 427/402, 434.2

[56] References Cited

U.S. PATENT DOCUMENTS

| | | | |
|---|---|---|---|
| 2,761,419 | 9/1956 | Mercier et al. | 118/412 |
| 2,761,791 | 9/1956 | Russell | 117/34 |
| 3,220,877 | 11/1965 | Johnson | 118/412 |
| 3,474,758 | 10/1969 | Russell | 118/412 |
| 3,893,410 | 7/1975 | Herzhoff et al. | 118/412 |
| 3,903,843 | 9/1975 | Jones | 118/412 |
| 3,928,678 | 12/1975 | Jackson | 427/402 |
| 3,928,679 | 12/1975 | Jackson et al. | 118/411 |
| 3,993,019 | 11/1976 | Jackson | 118/411 |
| 4,440,811 | 4/1984 | Hitaka et al. | 427/402 |
| 4,480,583 | 11/1984 | Tanaka et al. | 118/410 |
| 5,105,760 | 4/1992 | Takahashi et al. | 118/411 |
| 5,143,758 | 9/1992 | Devine | 118/411 |
| 5,154,951 | 10/1992 | Finnicum et al. | 427/402 |
| 5,154,952 | 10/1992 | Finnicum et al. | 118/411 |

FOREIGN PATENT DOCUMENTS

| | | | |
|---|---|---|---|
| 0525332A1 | 2/1992 | European Pat. Off. . | |
| 3110821 | 2/1982 | Fed. Rep. of Germany | 118/412 |

*Primary Examiner*—W. Gary Jones
*Assistant Examiner*—Mark De Simone

[57] ABSTRACT

An improved lip geometry for slide-bead coating includes a lip surface which is of a sufficient length to provide preferential pinning at a land edge. Slide-bead coating is employed in the manufacture of single- and multi-layered elements such as photographic film.

5 Claims, 5 Drawing Sheets

COATING LIP GEOMETRY FOR SLIDE BEAD COATING

This is a continuation of application Ser. No. 07/823,696 filed Jan. 21, 1992, now abandoned.

FIELD OF THE INVENTION

This invention relates to a slide bead coating apparatus. More specifically, this invention relates to a slide bead coating apparatus for coating one or more liquid layers onto a moving substrate.

BACKGROUND OF THE INVENTION

Slide-bead coating is a process well known in the art. It entails flowing a liquid layer or layers down an inclined slide surface to an efflux end, or lip, positioned a short distance from a moving substrate. The liquid forms a bridge, or bead, in the gap between the lip and the moving substrate. The moving substrate carries away liquid from the liquid inventory in the bead in the same layered structure established on the slide. See, for example, Russell, et al., U.S. Pat. Nos. 2,761,791 and 2,761,419.

For a given coater arrangement, coating liquid, and flow conditions, the range of applied differential pressures giving a satisfactory coating is a function of substrate velocity and is limited by the onset of bead instabilities and/or other practical considerations. As described by Saito, et al, in "Instability of the Slide Coating Flow" 1982 Winter National AIChE Meeting, Orlando, Fla., the coating bead becomes unstable giving rise to evenly-spaced disturbances in the subsequent coating when the substrate surface velocity and/or differential pressure are too high. On the other hand, if the differential pressure is too low, the width of the bead decreases undesirably and/or the bead becomes unstable thereby creating a coating which is too narrow and/or is disturbed. The unsatisfactory results from a differential pressure that is too high or too low define an operating window which is herein called a useful differential pressure range for producing coatings of satisfactory quality and width.

Unfortunately, operation within the useful differential pressure range alone does not guarantee a satisfactory coating. Surface and fluid dynamic forces, particularly at the lip surface, also affect the coating quality. In the lip region of a conventional coater, as shown in FIG. 2, the lip surface, 17, is typically longer than 0.5 mm. Immediately after coating is started, a static contact line, 18, of the bead forms at some location along this lip surface, 17. The location of the static contact line, 18, is typically from 0.05 to 0.50 mm below the lip tip, 16, and is determined for a given lip geometry by a balance of forces that can be resolved into fluid dynamics, applied differential pressure, and local surface forces acting along the lip surface, 17.

The effect of applied differential pressure on the static contact line position, 18, and the dynamic contact line position, 19, can be observed, correlated and predicted. Increasing the differential pressure will result in static contact line movement to say position 18'. Decreasing the applied differential pressure will result in static contact line movement to say position 18''.

The effect of the surface and fluid dynamic forces on static contact line position 18 is more complex and difficult to predict. In the vicinity of the static contact line, these forces tend to be weak and therefor do not dictate a strongly preferred location for the static contact line under a given set of operating conditions. Consequently, when establishing a new static contact line, any nonuniformity in either the surface or in the transient flow can result in an irregularity in the contact line straightness across the transverse extent of lip 17. Such static contact line irregularity interferes with the uniformity of the bead and can generate an undesirable variation in the thickness of the coating across the substrate. These thickness defects, often called streaks in the coating art, may render the resulting material unusable for the intended application. Surface nonuniformities leading to static contact line irregularities include local deposits from the coating solution, substrate-, liquid- or gas-borne foreign matter, lip surface contaminations and physical damage.

Various lip surface modifications have been proposed to avoid the occurrence of the streak defects. In Kitaka and Takemasa, U.S. Pat. No. 4,440,811, the coater lip region is modified to include a notch whereby the bead contact line is preferentially located along the notch tip. However, the proposed configuration is expensive to fabricate to the precision required and, in practice, the notch is difficult to clean and promotes deposits and settling from the flowing material. In addition, most configurations incorporating the notch produce lip tip-to-substrate gaps that are larger than the narrowest mechanical gap by a length equal to the extent of the notch. This arrangement undesirably results in a reduced maximum useful differential pressure. The decrease in operational latitude translates into a decrease in the absolute range of differential pressure within which bead uniformity is maintained and may also reduce the achievable coating speed which decreases overall productivity of the coating apparatus.

Japanese Patent Publication No. 48-4371 discloses use of a land inclined with respect to the substrate tangent so as to locate the wetting line at the sharp coating lip. The sharp lip region is excessively vulnerable to mechanical damage such as a crack or scratch that would cause streaks in the coating. To avoid this problem, U.S. Pat. No. 3,928,678 discloses rounding or bevelling the lip tip to increase mechanical strength of the lip tip and move the bead static contact line away from the lip tip. But, no dimensions or orientations are disclosed for maintaining the bead static contact line at a preferred or advantageous position. As stated by Hitaka et.al., in U.S. Pat. No. 4,440,811 in reference to using such a bevel: " . . . it was difficult to hold the end of the beads at a fixed place or to restore the said end to the original state." Furthermore, the bevel depicted in U.S. Pat. No. 3,928,678 results in a larger lip tip-to-substrate gap than the narrowest mechanical gap with the attendant loss in maximum useful differential pressure.

SUMMARY OF THE INVENTION

In a first aspect, the invention is directed to slide bead coating apparatus comprising a means for continuously supplying a liquid layer or layers simultaneously to a slide surface of a coating head; a bead region wherein the liquid layer or layers is continuously applied to a moving substrate; a roller, and associated drive means, for conveying said substrate longitudinally through said bead region; and a coating lip tip at the terminus of said slide surface of said coating head and within said bead region. The coating apparatus further comprises:

an upper lip land which is 0.05 mm to 0.50 mm long and extends downward from the coating lip tip of said coating head within said bead region, wherein an alpha angle between said upper lip land and an imaginary plane which contains both the rotational axis of said roller and said coating lip tip is 45° to 135°;

a lower lip surface extending from said upper lip land at an angle of no more than 155° wherein the intersection of said lower lip surface and said upper lip land form a land edge; and a means for supplying a differential pressure to a bead of said liquid layer or layers between said substrate and said land edge.

In a second aspect, the invention is directed to a method for forming a photographic element wherein said photographic element comprises a substrate and at least one hydrophilic colloid layer at least one of which is a photosensitive layer. This method comprises the steps of:

supplying a layer or layers of said hydrophilic colloid to the slide surface of a coating head of the slide bead coating apparatus described in the above paragraph;

flowing said layer or layers into the gap between said substrate and the coating lip tip at the terminus of said slide surface thereby forming a bead region;

longitudinally conveying said substrate through said bead region wherein said hydrophilic colloid is continuously removed from said bead region in the form of a liquid film coating on said substrate; and removing volatile components from said liquid film coating on said substrate thereby forming a substantially rigid hydrophilic colloid coating on said substrate.

DETAILED DESCRIPTION OF THE INVENTION

Throughout the following description, similar referenced characters refer to similar elements in all drawings.

Figure 1:
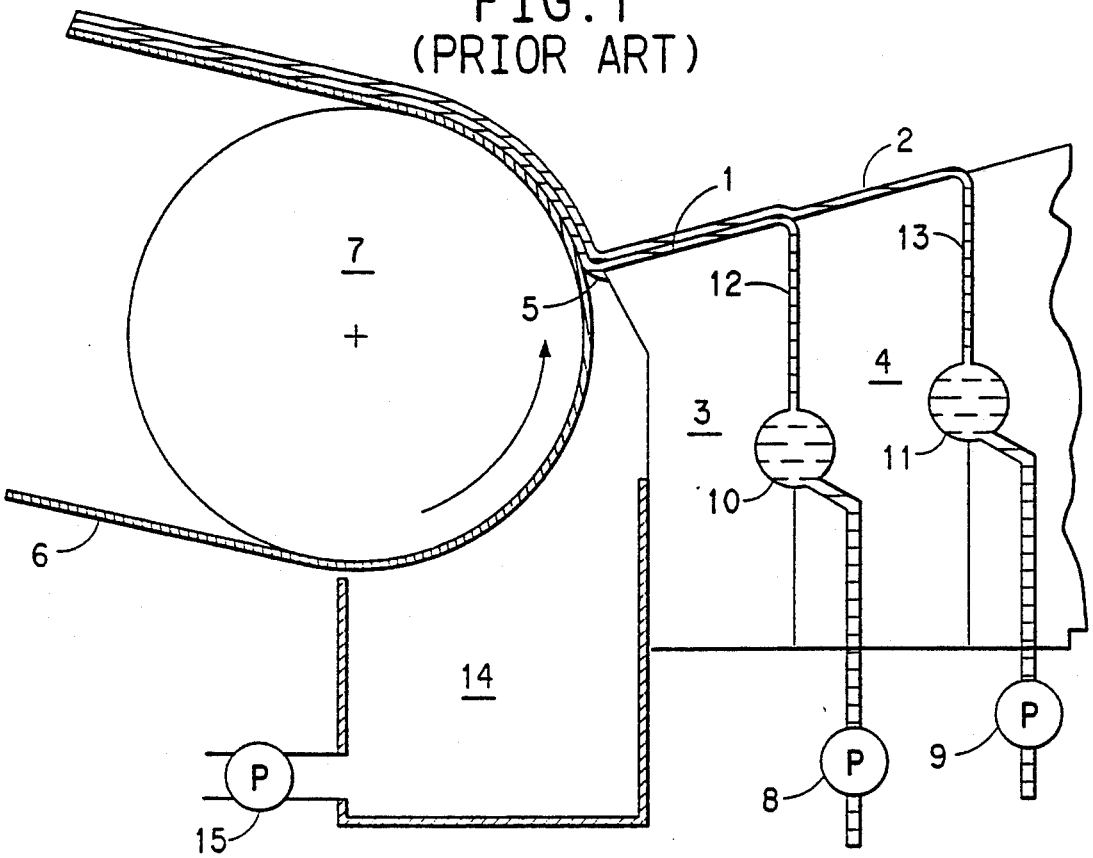
FIG. 1 (PRIOR ART)
FIG. 1 is a schematic representation of a conventional slide bead coater.

In conventional slide bead coating apparatus, as illustrated in FIG. 1, the liquids to be coated, 1 and 2, are supplied to plates 3 and 4. Coating additional layers requires additional plates which can readily be included but are not illustrated here. The liquids 1, 2 flow down the inclined slide surface of the plates and traverse a gap, 5, between the closest plate, 3, and the substrate, 6, thereby coating the substrate. The substrate, 6, is conveyed by a coating roll, 7. Coating liquid is supplied by an appropriate number of supply pumps 8, 9 which feed into cavities 10, 11 and slots 12, 13. An appropriate number of pumps, cavities and slots are required to coat more layers than depicted in the figure. A chamber, 14, and associated pump, 15, controls the gas pressure on the lower surface of the liquid in the gap, 5, such that the pressure at the lower liquid surface is less than the pressure at the upper liquid surface.

Figure 2:
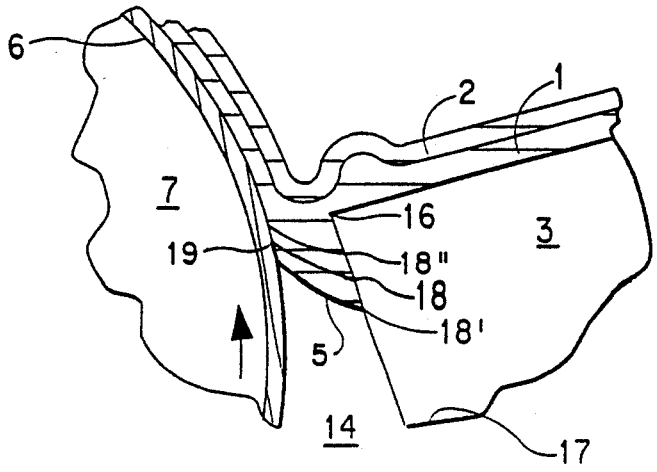
FIG. 2 (PRIOR ART)
FIG. 2 is a detailed view of the bead region of a conventional slide bead coater.

Focusing on the gap, or bead, region depicted in FIG. 2, coating liquids 1, 2 flow down the slide surface and over the coater lip tip, 16, to form a continuous liquid bridge between the lip surface, 17, and the substrate, 6. The closest distance between the lip tip, 16, and the substrate surface, 6, referred to as the coating gap, 5, is typically 0.1 to 0.5 mm. The differential pressure between the gas above the top liquid surface, usually at atmospheric pressure, and the gas below the bottom liquid surface as applied by chamber, 14, draws the liquid bead into the gap between the lip surface, 17, and the substrate, 6. Typical pressure differentials of 400 to 4000 dynes/cm$^2$ are applied. The applied differential pressure produces a stable bead with a spatially-stationary liquid wetting line, or static contact line, 18, on the coater lip surface, 17, and a spatially-stationary liquid wetting line, or dynamic contact line, 19, on the moving substrate, 6. Typical substrate speeds are 25 to 300 cm/sec.

Figure 3:
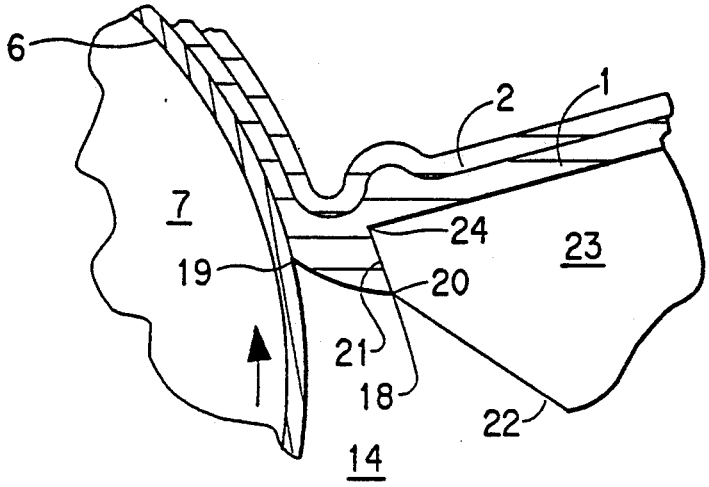
FIG. 3 is a detailed view of the bead region of an embodiment of the present invention.

FIG. 3 shows an embodiment of the present invention. The coater geometry in the lip region is configured such that over a useful range of operating conditions the static contact line, 18, will be preferentially located at a corner, or land edge, 20, formed by the intersection of an upper lip land, 21, and a lower lip surface, 22, on the lip 23 of the coater plate below the lip tip, 24. The length of the upper lip land, 21, is preferentially 0.05 mm to 0.50 mm, and more preferably 0.10 mm to 0.30 mm. With an upper lip land length greater than 0.50 mm, the static contact line, 18, does not pin at the land edge, 20, over a useful range of operating conditions. Without pinning, the resulting irregularity in the static contact line interferes with bead uniformity and can lead to streak defects. With an upper lip land length less than 0.05 mm, the upper lip land, 21, and lower lip surface, 22, must form a sufficiently sharp corner at 20 to achieve preferential contact line location over a useful operating condition range as to make the lip, 23, structurally weak and thus excessively vulnerable to mechanical damage.

Figure 4:
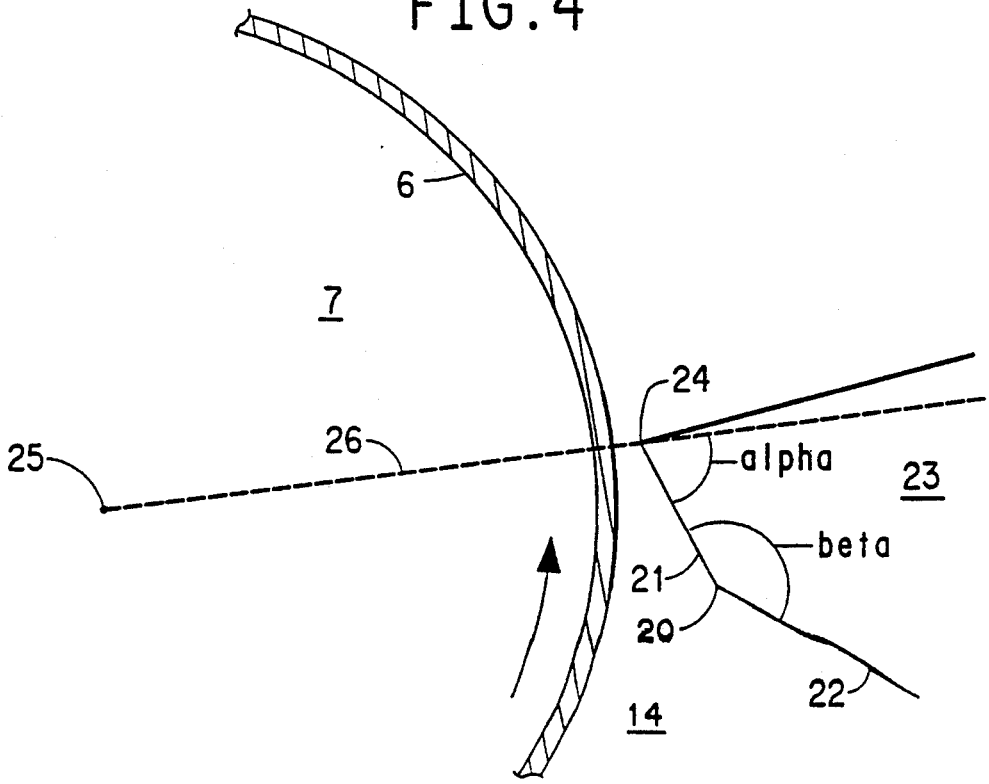
FIG. 4 is a schematic representation of the orientation of the present invention.

Focusing more closely at the slide surface upper lip land and lower lip surface, FIG. 4 depicts the reference system by which the geometry of the invention is herein defined. A rotational axis line of the coating roll is represented in projection as an axis point, 25. A plane is defined which contains the axis line and the coating lip tip, 24. In projection this plane is represented by a line 26. An angle between the line, 26, and the upper lip land, 21, is defined as alpha. The solid angle between the upper lip land, 21, and the lower lip surface, 22, is defined as beta.

The angle alpha is preferably 45°–135°. More preferably alpha is 70°–100°. The useful operational latitude decreases for angles of alpha greater than 100° and significantly so for angles of alpha above 135°. The decrease in operation latitude means a smaller absolute range of differential pressure within which bead uniformity is maintained The achievable coating speed and, hence, the overall productivity of the coating apparatus may also be reduced.

The angle beta is preferably at least 90° for most practical overall coater configurations (i.e., for most practical combinations of slide inclination and coating application location on the coating roll, 7) but should not exceed 155°. More preferably beta is 120°–145°. At beta angles of less than about 90° and/or at alpha angles smaller than about 45°, the lip 23 becomes structurally weak which increases fabrication difficulty and subsequent operational difficulties. When beta is greater than about 155°, the land edge becomes only a weakly preferred static contact line position. Consequently, the static contact line will frequently not be straight but rather erratic with segments of the contact line being locate along portions of the transverse extent of the land edge 20 and other segments being at different positions along other transverse portions of the lip 23. The result is irregularities in the static contact line and undesirable streak defects.

The configuration of the invention can be employed in slide coaters with any practical application point about the coating roll and any practical inclination of slide surface. The advantages offered by the invention to slide coaters with these different overall configurations would qualitatively be present but to varying quantitative degrees. Also, implementation of this invention in some extreme cases may be limited by practical considerations such as mechanical interferences, mechanical strength and proper drainage from surfaces as would be obvious to one skilled in the art. In addition, the improved lip geometry is described above as having a land edge, 20, or line of intersection, between the upper lip land, 21, and the lower lip surface, 22, but variations of this configuration are also beneficial and are included in the invention. For instance, curved surfaces, such as cylindrical concave surfaces, can be substituted for a flat upper lip land and/or a flat lower lip surface in order to achieve and enhance the preferential positioning of the static contact line. Preferential positioning of the static contact line in these cases can be accomplished if the lip geometry is within the previously described bounds of upper land length, alpha, and beta and these parameters are defined in a generalized sense. An example with both concave upper land and concave lower lip surface would possess generalized geometric features as follows: Upper land length 21 is taken as the length along a straight line subtending the upper land between the lip tip 24 and the upper land edge 20. Alpha is the angle between this subtending line and the line 26 between the coating roll centerline 25 and the lip tip 24. Beta is the angle between the subtending line and the tangent to the curved lower lip surface 22 taken at the land edge 20. Flat surfaces are preferred however, since they are less expensive to fabricate. Furthermore, the connecting surface geometry between the upper lip land and lower surface generally referred to herein as the land edge need not be restricted to a line of surface intersection for achieving beneficial results but can also be a small corner element such as with a small convex cylindrical sector, a corner of multiple small facets or a small chamfer. For these configurations the static contact line, 18, is substantially positioned preferentially on the corner. For optimum results in this regard, the characteristic dimension (e.g., radius of curvature) of the corner should be small since the magnitude of the advantages previously described decrease as the corner becomes larger.

The invention described herein is useful for a myriad of flowing liquids including, but not limited to, those with photosensitive and or radiation sensitive layers. These photosensitive and/or radiation sensitive layers may be any which are well-known for imaging and reproduction in fields such as graphic arts, printing, medical, and information systems. Silver halide photosensitive layers and their associated layers are prefered. Photopolymer, diazo, vesicular image-forming compositions and other systems may be used in addition to silver halide.

The film support for the emulsion layers used in the novel process may be any suitable transparent plastic or paper. Examples of suitable plastics include, but are not limited to, cellulosic supports, e.g., cellulose acetate, cellulose triacetate, cellulose mixed esters, polyethylene terephthalate/isophthalates and the like. The polyester films are particularly suitable because of their dimensional stability. During the manufacture of the film it is preferable to apply a resin subbing layer such as, for example, the mixed-polymer subbing compositions of vinylidene chloride-itaconic acid, taught by Rawlins in U.S. Pat. No. 3,567,452, or antistatic compositions as taught by Miller U.S. Pat. Nos. 4,916,011 and 4,701,403 and Cho U.S. Pat. No. 4,891,308 .

The coated element of a photographic film is dryed by liquid medium evaporation. The evaporation is preferably accelerated by conduction, convection and/or radiation heating. Heat transfer can occur through the support such as by physical contact with a heated drum or roller or by direct contact with a gaseous medium such as warm air. Jet impingement of the coated layers with a gaseous medium provides both a heat and mass transfer medium. Also, radiation to which the photographic element is relatively insensitive can be used to facilitate liquid medium evaporation.

The following examples are illustrative and are not intended to limit the scope of the invention described herein.

EXAMPLE 1

Figure 5:
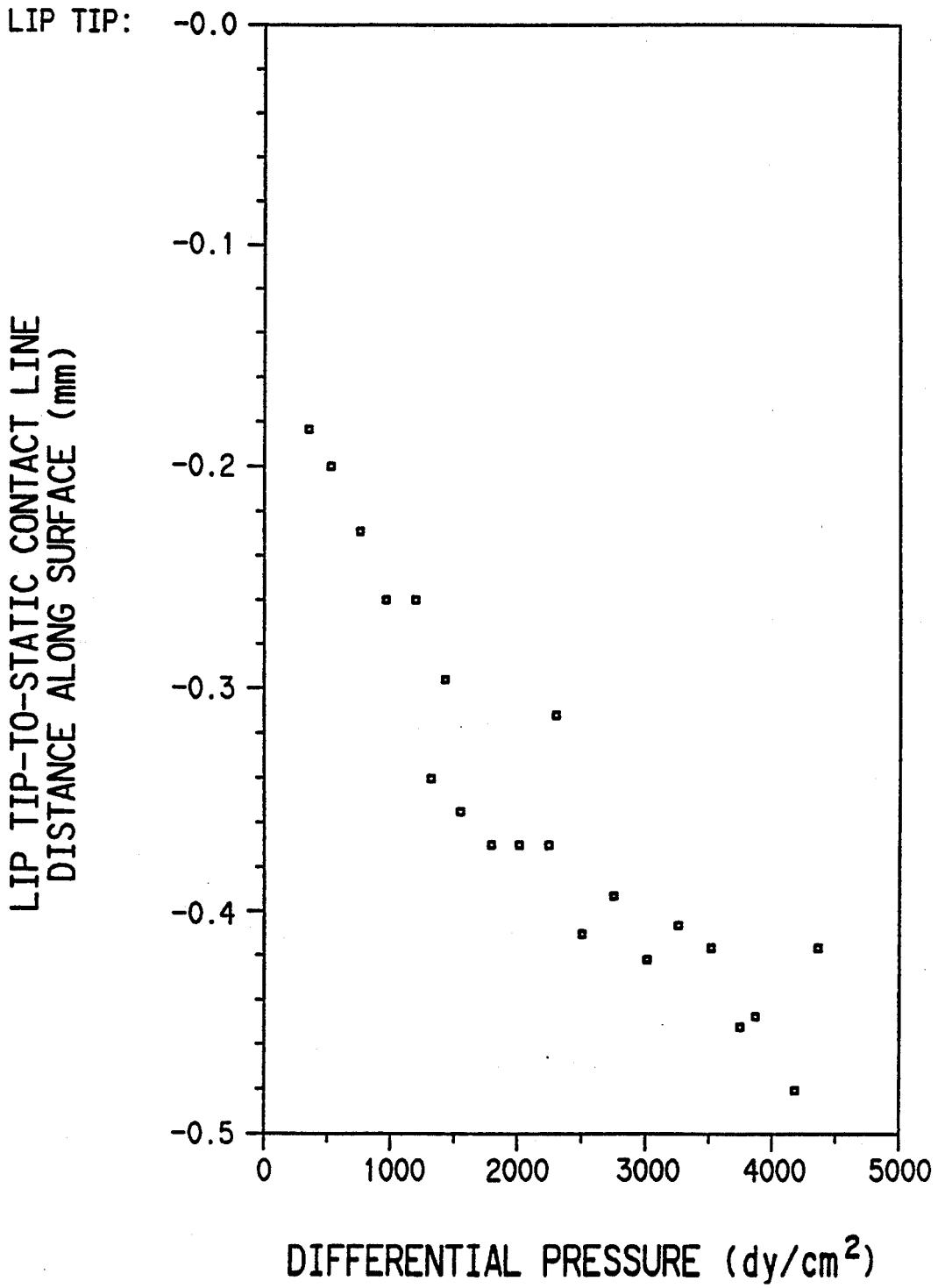
FIG. 5 graphically depicts the static contact line versus differential pressure for Example 1.

This is a control example for slide-bead coating two different layers simultaneously at 200 cm/min. The upper layer is a 9.3% gelatin-water solution (viscosity of 29 cp), coated at a thickness of 30 micrometers. The lower layer is a 5.4% gelatin solution with 8% AgBr in colloidal suspension (viscosity of 8.5 cp), also coated at a thickness of 30 micrometers. A slide coater with slide surface inclined approximately 23° from horizontal and positioned such that the coating lip and substrate surface are separated by a coating gap of 0.25 mm at approximately 18° above the horizontal centerplane of the roll. The lip land length was 0.75 mm, alpha was 85°, and beta was 155°. The static contact line position was observed through magnification as detailed in Valentini, et al., I&EC Research, 1991, 30, 453–461, after initiating the coating at the indicated applied differential pressure. FIG. 5 shows the plot of static contact line position versus differential pressure trials. The static contact line position more or less moves consistently further down the lip surface away from the lip tip as differential pressure is increased. The general trend in static contact line position with increasing differential pressure suggests the existence of an equilibrium position for a given precise set of operating parameters and coating initiation process, but the scatter in the observed positions about the trend curve indicates that the preference for a particular equilibrium position is rather weak.

EXAMPLE 2

Figure 6:
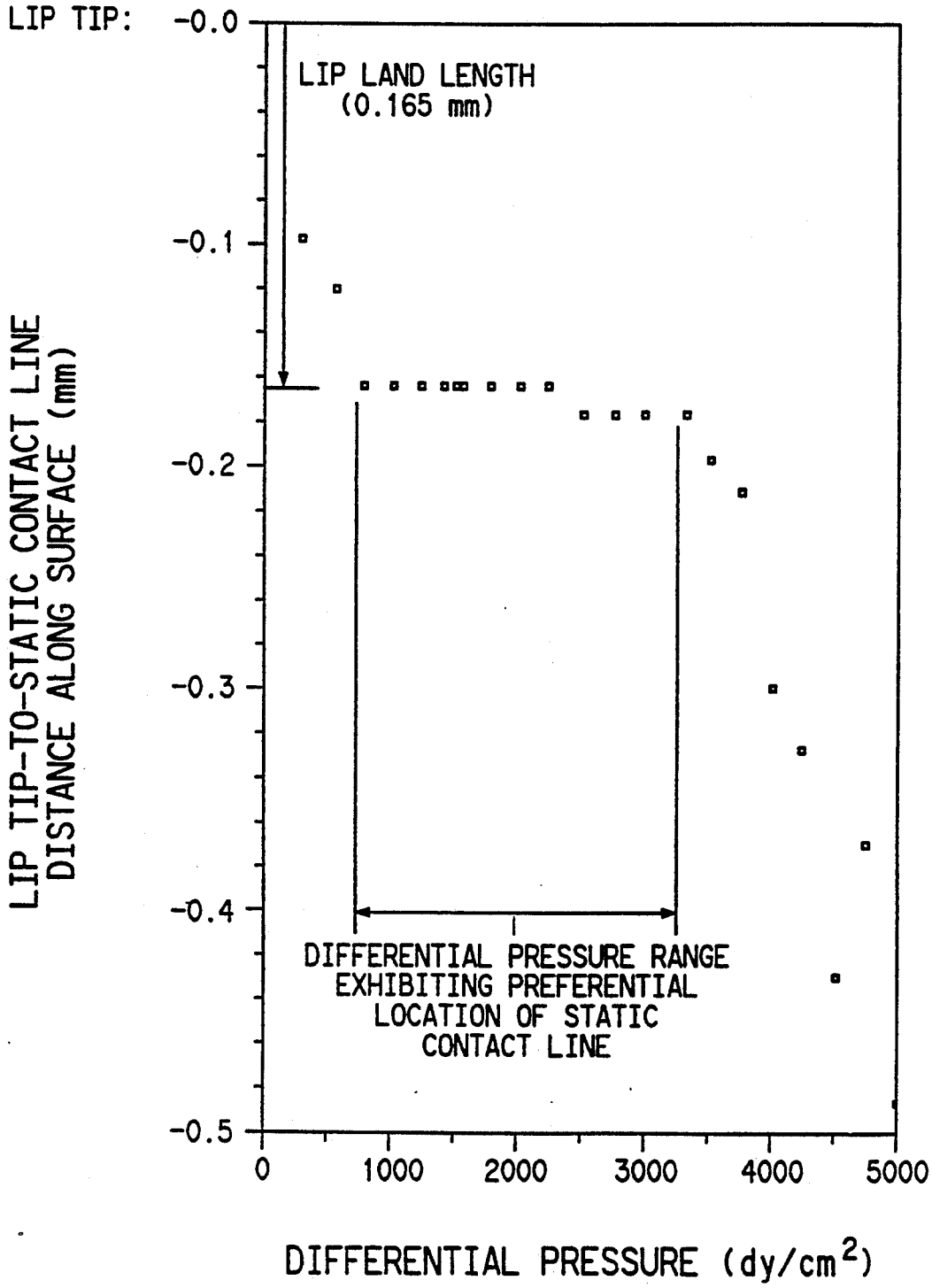
FIG. 6 graphically depicts the static contact line versus differential pressure for Example 2.

This example illustrates the invention. All conditions were the same as in Example 1 except that alpha was 85°, beta was 135°, and the lip land length was 0.165 mm. FIG. 6 shows a plot of static contact line position versus differential pressure. The static contact line position is located substantially at the land edge over the differential range of approximately 750 to 3300 dy/cm$^2$. As indicated by the excellent repeatability of the observed static contact line positions, this lip configuration results in a strongly preferred static contact line location over a substantial and practical range of applied differential pressures.

EXAMPLE 3

Figure 7:
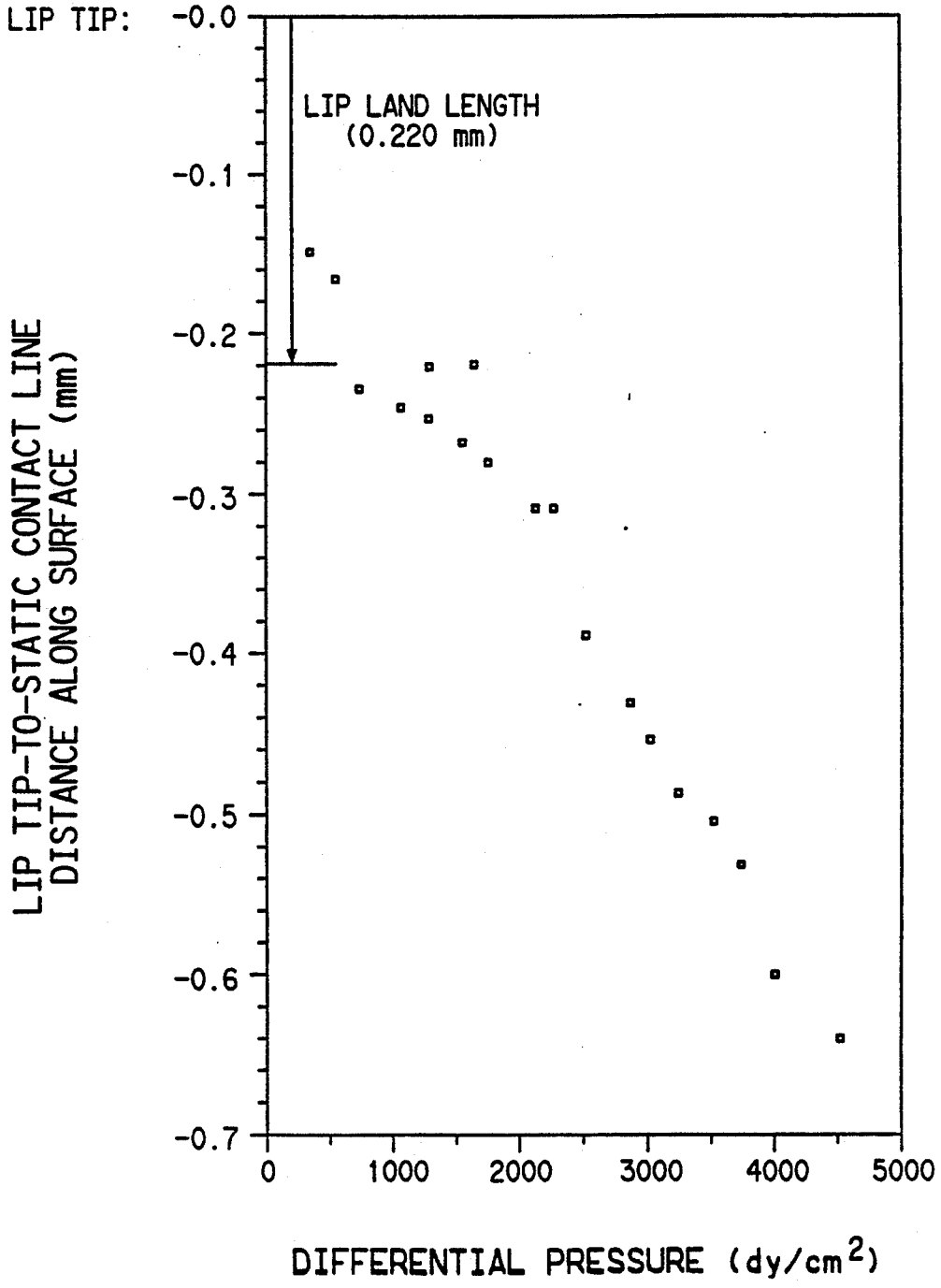
FIG. 7 graphically depicts the static contact line versus differential pressure for Example 3.

This is a comparative example. All conditions were the same as in Example 1 except that alpha was 85°, beta was 160°, and the lip land length was 0.220 mm. FIG. 7 shows a plot of static contact line position versus differential pressure. The static contact line position located substantially at the land edge over the differential range of approximately 750 to 1600 dy/cm$^2$ in some trials but not in others. In addition, the static contact line was observed to be irregularly-shaped and not straight as experienced in Example 2. Both the lack of positioning repeatability and the irregular static contact line shape indicate only weak preferential positioning of the static contact line.

I claim:

1. A slide bead coating apparatus comprising:

a means for continuosly supplying a liquid layer or layers simultaneously to a slide surface of a coating head;

a bead region wherein the liquid layer or layers is continuously applied to a moving substrate;

a roller, and associated drive means, for conveying said substrate longitudinally through said bead region; and a coating lip tip at the terminus of said slide surface of said coating head and within said bead region;

said coating apparatus further comprising:

an upper lip land which is 0.05 mm to 0.50 mm long and extends downward from the coating lip tip of said coating head within said bead region, wherein an alpha angle between said upper lip land and an imaginary plane which contains both the rotational axis of said roller and said coating lip tip is 45° to 90°;

a lower lip surface extending from said upper lip land at an angle of no more than 155° wherein the intersection of said lower lip surface and said upper lip land form a land edge; and a means for supplying a differential pressure to a bead of said liquid layer or layers between said substrate and said land edge.

2. The apparatus of claim 1, wherein said upper lip land is 0.10 mm to 0.30 mm long.

3. The apparatus of claim 1, wherein said alpha angle is at least 70°.

4. The apparatus of claim 1, wherein the angle between said upper lip land and said lower lip surface is 90° to 155°.

5. The apparatus of claim 4, wherein said angle between said upper lip land and said lower lip surface is 120° to 145°.

* * * * *